US005588405A

United States Patent [19]

Sawa et al.

[11] Patent Number: 5,588,405

[45] Date of Patent: Dec. 31, 1996

[54] ARRANGEMENT OF OIL PASSAGE TO VALVE SYSTEM

[75] Inventors: Atsushi Sawa; Hiroyuki Kawakubo, both of Saitama, Japan

[73] Assignee: Honda Giken Kogyo Kabushiki Kaisha, Tokyo, Japan

[21] Appl. No.: 476,571

[22] Filed: Jun. 7, 1995

[30] Foreign Application Priority Data

Dec. 28, 1994 [JP] Japan ..... 6-337588

[51] Int. Cl.[6] ..... F01M 5/00; F01M 9/10

[52] U.S. Cl. ..... 123/90.33; 123/196 R; 123/196 M

[58] Field of Search ..... 123/90.27, 90.31, 123/90.33, 90.34, 90.38, 196 R, 196 M

[56] References Cited

U.S. PATENT DOCUMENTS

| | | | |
|---|---|---|---|
| 4,656,983 | 4/1987 | Anno | 123/196 R |
| 4,729,349 | 3/1988 | Sonoda et al. | 123/196 R |
| 4,911,120 | 3/1990 | Sumi | 123/196 R |
| 5,090,375 | 2/1992 | Hudson | 123/196 R |
| 5,161,495 | 11/1992 | Saito | 123/90.33 |
| 5,195,472 | 3/1993 | Jacques et al. | 123/90.33 |
| 5,309,878 | 5/1994 | Kandler et al. | 123/196 M |

FOREIGN PATENT DOCUMENTS 54-96648 7/1979 Japan .

*Primary Examiner*—Weilun Lo

*Attorney, Agent, or Firm*—Birch, Stewart, Kolasch & Birch, LLP

[57] ABSTRACT

An arrangement of oil passages to a valve system can reduce the number of parts required thereby lowering the manufacturing cost. The oil passages to a valve system of an internal combustion engine are integrally formed with the cylinder block and a cylinder head. These oil passages are arranged along the outer surfaces on a side opposed to a cylinder liner and a combustion chamber relative to a valve system drive transmission.

20 Claims, 5 Drawing Sheets

ARRANGEMENT OF OIL PASSAGE TO VALVE SYSTEM

BACKGROUND OF THE INVENTION

1. Field of the Invention

The present invention relates to an arrangement of oil passages for supplying oil to a valve system in an internal combustion engine of a type having a valve system in a cylinder head.

2. Description of the Background Art

The internal combustion engine of this type requires an oil passage communicating a crank case side oil supply passage to a valve system disposed in a cylinder head over a crank case beyond a cylinder. The passage supplies lubrication oil not only to a specified bearing portion of a crank shaft and a transmission in the crank case, but also to the valve system.

The internal combustion engine having the above-described oil passage has been known, for example, as disclosed in Japanese Patent Publication No. SHO 59-24281. Hereinafter, one example of a conventional internal combustion engine of a four-cycle type for a motor-bicycle will be described with reference to FIGS. 4 and 5.

An internal combustion engine 01 is an overhead cam OHC engine, which includes a cylinder head 04 and a cam shaft 07 in a head cover 05. The cam shaft 07 positioned over a cylinder of a cylinder block 03 is separated from a crank shaft 06 in a crank case 02. Therefore, when driving the cam shaft 07, a cam chain 08 is hung between both the shafts.

Oil fed by an oil pump 09 assembled in the crank case 02 is supplied to a connecting rod 012 and bearing portions such as gears through oil passages in the crank shaft 06, a main shaft 010 of the transmission, and a counter shaft 011. Further, an oil pipe 015 connected to the oil passage provided in the crank case 02 extends exteriorly and is led upwardly along the outer surfaces of the cylinder block 03 and the cylinder head 04, and is in communication with the cylinder head 04 and an oil chamber 016 in the head cover 05.

The oil chamber 016 is disposed at the end portion of the cam shaft 07 for supplying oil in an oil passage 07*a* formed in the cam shaft 07. The oil passage 07*a* has a plurality of branched passages 07*b* toward the outer peripheral surface for supplying oil to bearing portions and the sliding contact surface of a rocker arm 017.

As described above, oil is supplied from the crank case 02 into the cylinder head 04 by way of the oil pipe 015 disposed outside the internal combustion engine 01. Since the oil pipe 015 is disposed outside the internal combustion engine, it is possible to avoid heat sources such as a cylinder and combustion chamber and expect a cooling effect. Therefore, oil can be supplied to the valve system without heating thereof.

SUMMARY AND OBJECTS OF THE INVENTION

In the above method, the oil pipe 015 is additionally required, thereby increasing the number of parts and requiring assembly thereof. This is disadvantageous in terms of manufacturing cost.

In view of the foregoing, the present invention has been made, and an object of the present invention is to provide an arrangement structure of oil passages to a valve system, which is capable of reducing the number of parts thereby lowering the cost.

To achieve the above object, according to the present invention, an arrangement of oil passages to a valve system is provided. The oil passages to a valve system in an internal combustion engine are formed integrally with a cylinder block and cylinder head. The oil passages are arranged along the outer surfaces on the opposed side to a cylinder liner and a combustion chamber relative to a valve system drive transmission.

Since oil passages to the valve system are formed integrally with the cylinder block and the cylinder head, it is possible to eliminate separate parts such as an oil pipe and to reduce the assembling work thereof, and hence to reduce the manufacturing cost.

The oil passages are positioned at the opposed side to the cylinder liner and combustion chamber relative to the valve system drive transmission, so that it is possible to avoid direct heating due to the heat sources. Further, since the oil passages are formed along the outer surface, there can be a cooling effect. Consequently, the oil not heated can be supplied to the valve system.

Since the valve system drive transmission is constituted of a cam chain for transmitting the rotation of the crank shaft to the cam shaft of the valve system, the cam chain is disposed in spaces which are effective to separate the oil passages from the cylinder liner and the combustion chamber. Accordingly, it is difficult to transmit the heat of the heat sources to the oil passages. A cooling effect can be also obtained.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

PREFERRED EMBODIMENTS OF THE INVENTION

Figure 1:
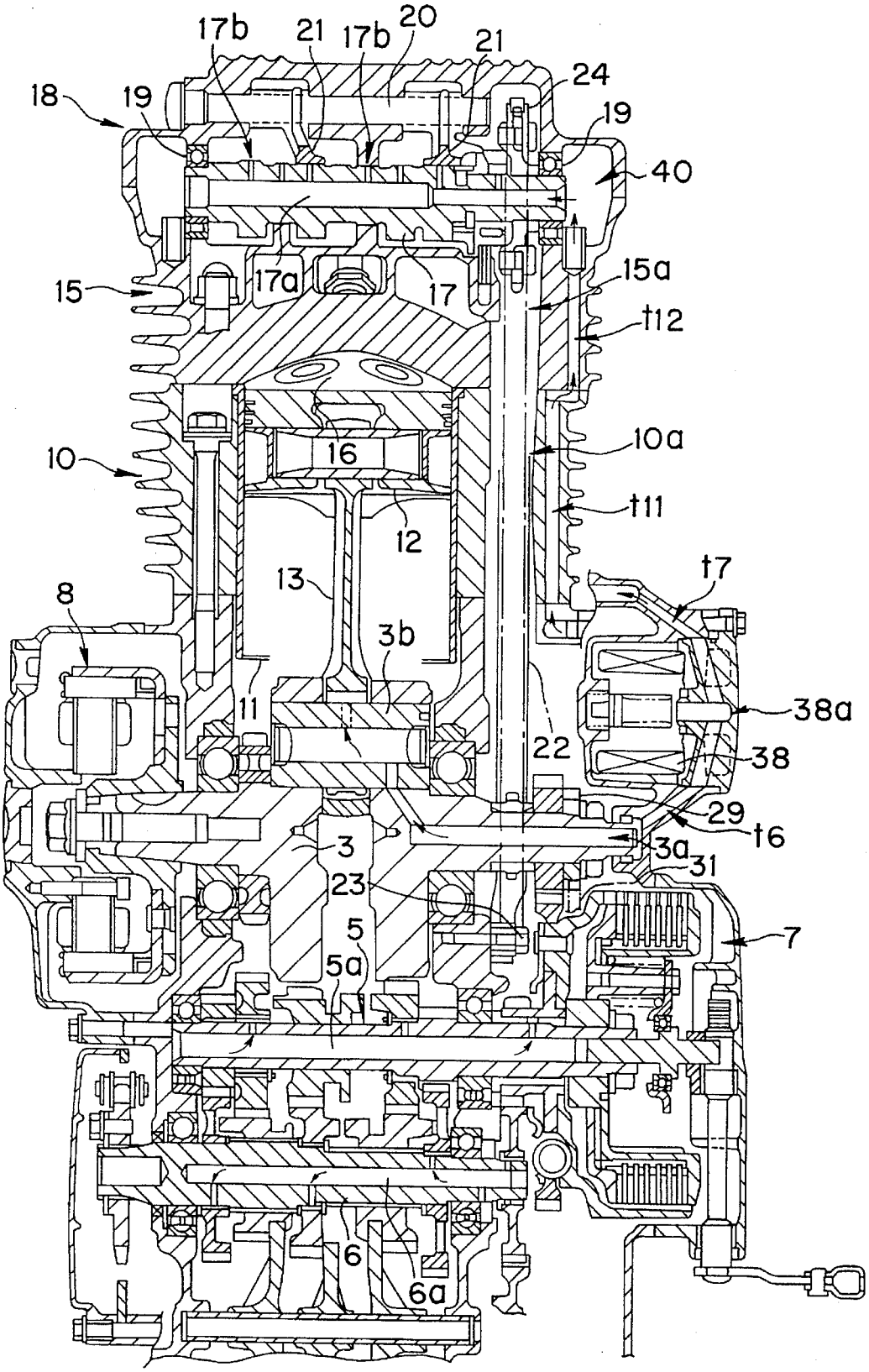
FIG. 1 illustrates a sectional view of an internal combustion engine according to one embodiment of the present invention.

Hereinafter, one embodiment of the present invention will be described with reference to FIGS. 1 to 3. An internal combustion engine 1 in this embodiment is a one-cylinder/four-cycle OHV engine for a motor-bicycle.

A crank shaft 3 and a transmission 4 are positioned in back of the crank shaft 3 and are contained in a crank case 2. The transmission 4 has a construction that a gear group fitted to a main shaft 5 is suitably meshed with a gear group fitted to a counter-shaft 6. A kick shaft 9 is positioned under the counter-shaft 6. A clutch 7 is disposed at the end portion of the main shaft 5, and an AC generator 8 is disposed at the end portion of the crank shaft 3.

A piston 12 is slid within a cylinder liner 11 of a cylinder block 10. The piston 12 is connected to a crank pin **3*b* of the crank shaft 3 by means of a connecting rod 13**.

A cylinder head 15 connected to the cylinder block 10 forms a combustion chamber 16 over the cylinder liner 11. At the upper side thereof a bearing of a cam shaft 17 vertically holds the cam shaft 17 together with a bearing on the head cover 18 side. The cam shaft 17 is rotatably supported at both ends by bearings each having a sealing effect.

A pair of rocker shafts 20 are provided across the head cover 18, and a rocker arm 21 rotatably supported by the rocker shaft 20 is disposed such that the rocking end is slidably contacted with the cam peripheral surface of the cam shaft 17.

A cam chain 22 is used for transmission of power to the cam shaft 17 separated from the crank shaft 3 while putting the cylinder therebetween. A cam chain 22 is inserted into a chain path **10*a* formed in the cylinder side wall of the cylinder block 10 and a chain path 15*a* of the cylinder head 15 which extends from the chain path 10*a*. The cam chain 22 is hung between a sprocket 23 of the crank shaft 3 and a sprocket 24 of the cam shaft 17**.

An oil pump 30 is assembled rightwardly and downwardly from the crank shaft 3. An oil pump drive gear 29 fitted to the crank shaft 3 is meshed with an oil pump driven gear 31 fitted to a pump drive shaft **30*a* for driving an oil pump 30**.

Figure 2:
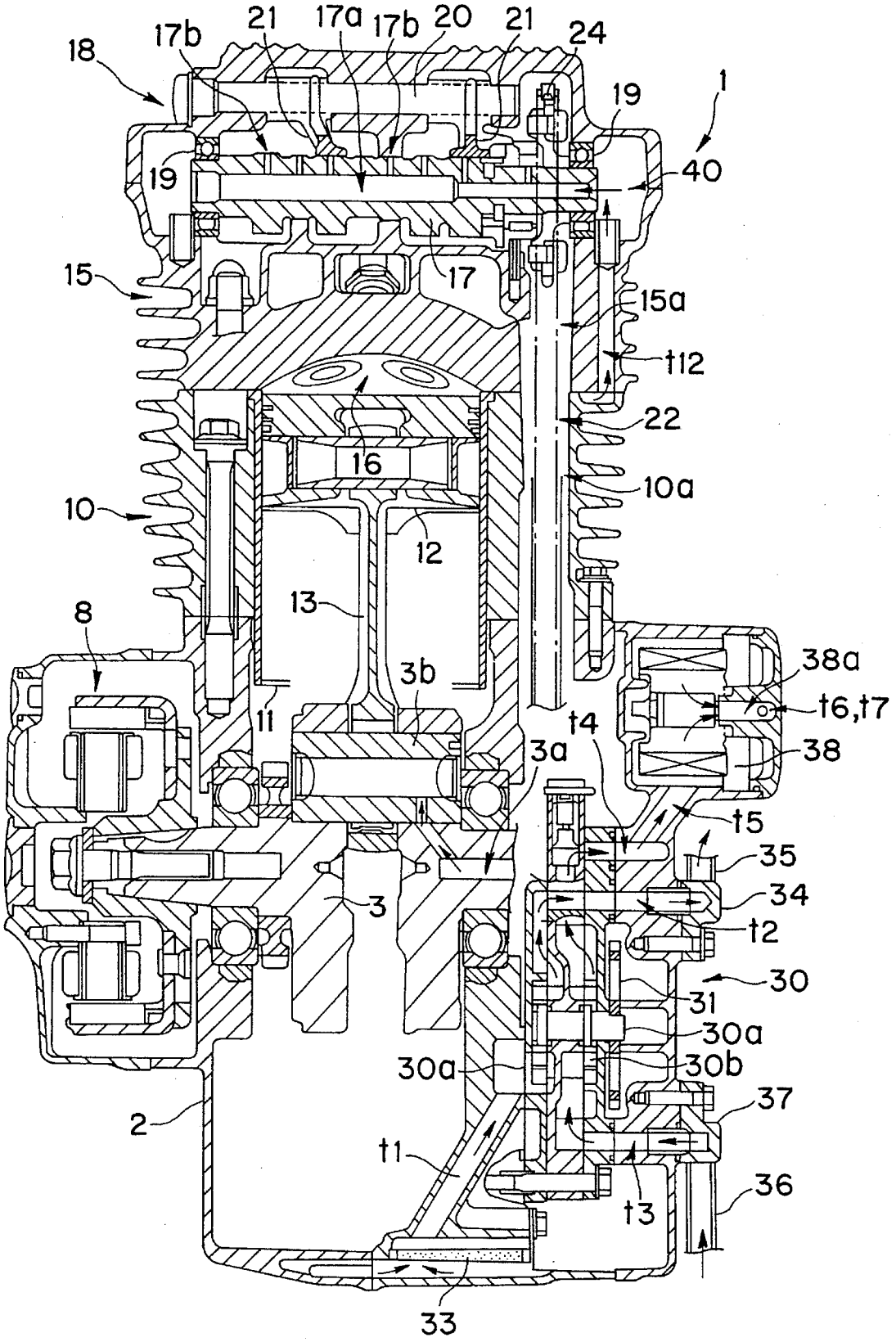
FIG. 2 shows a sectional view of an internal combustion engine, particularly showing the cross-sections of an oil pump and an oil circulating passage near the oil pump.
Figure 3:
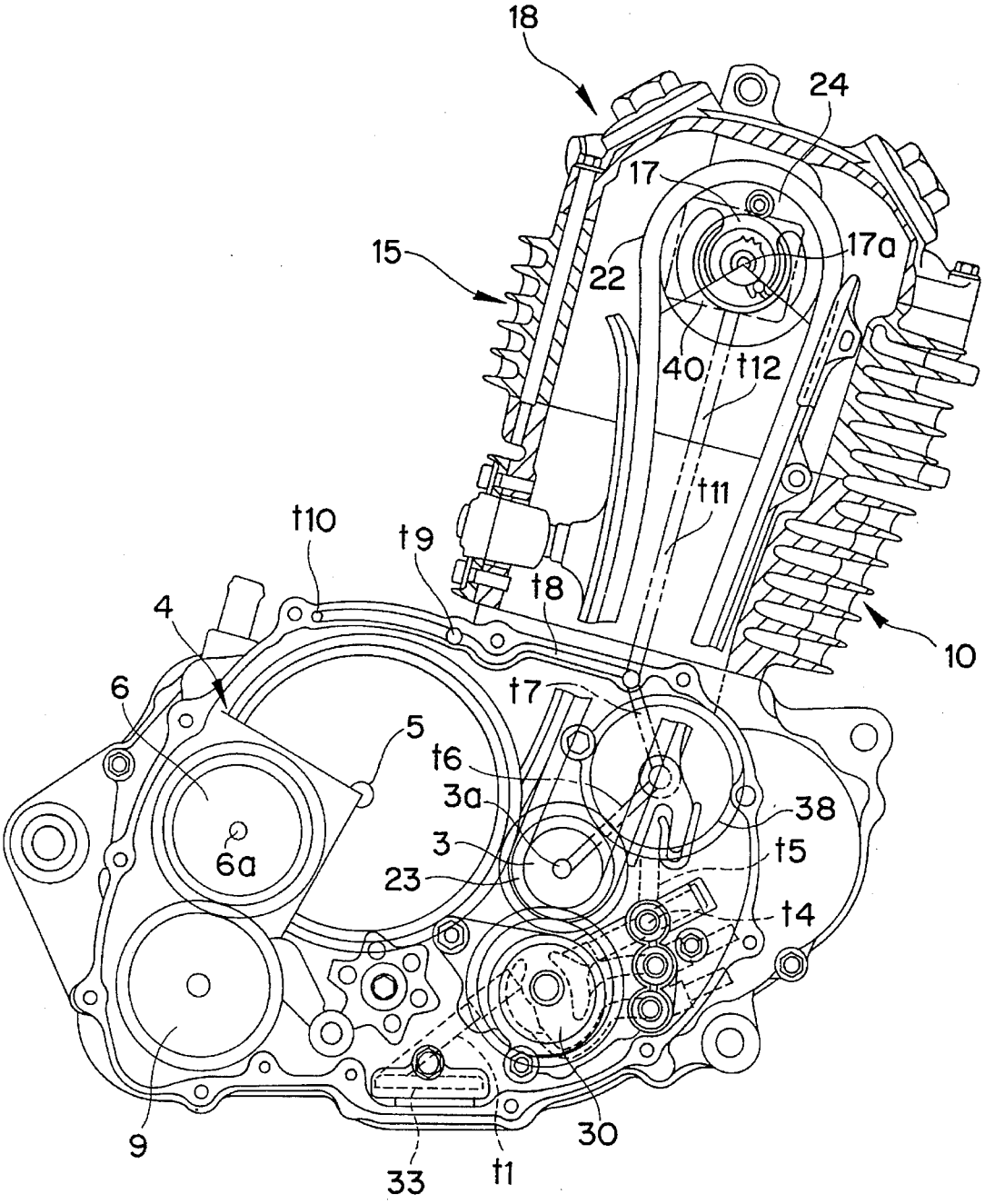
FIG. 3 shows a side view of an internal combustion engine with parts partially broken away, showing the interior of a crank case in the state that the cover is removed.
Figure 4:
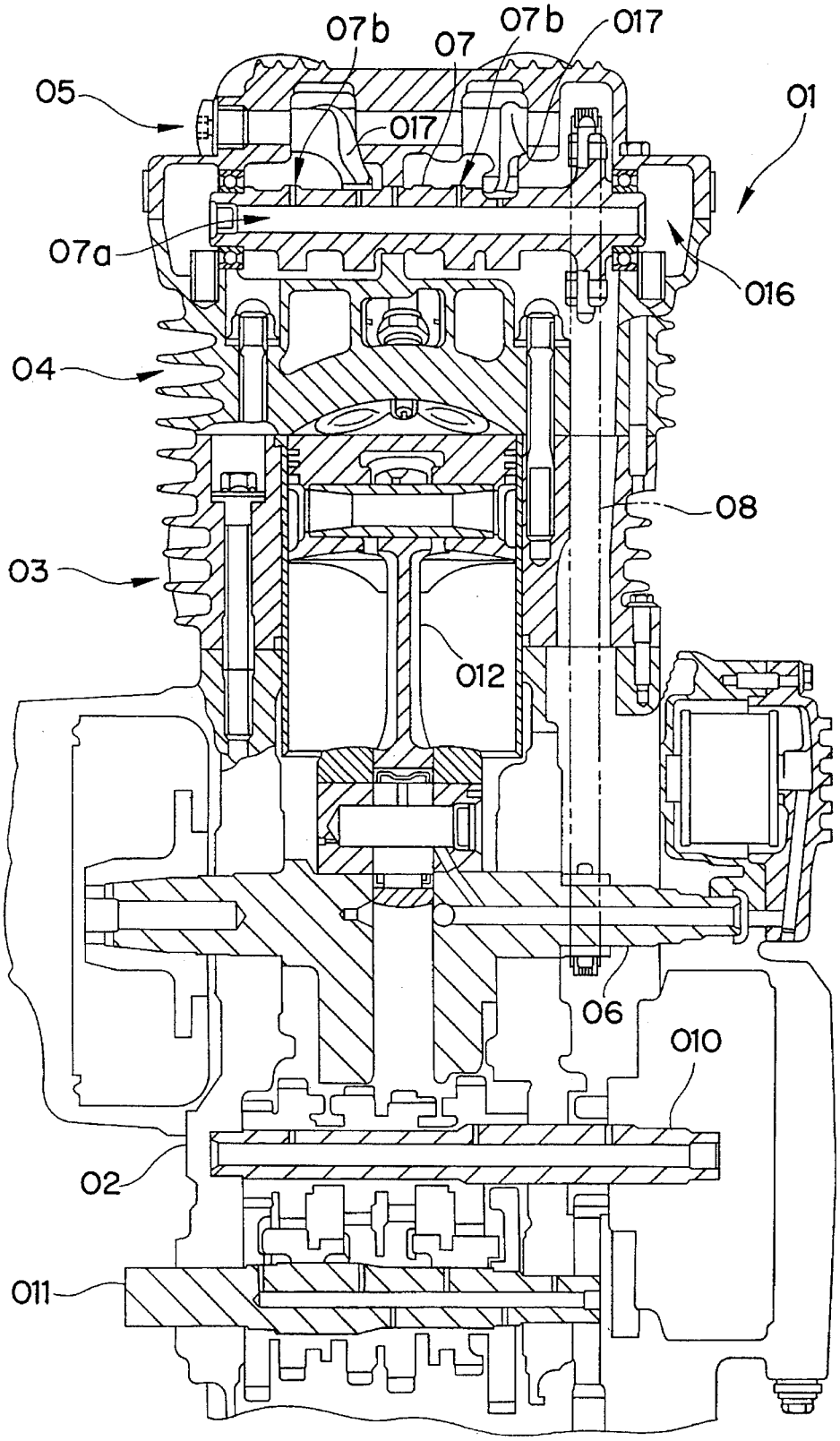
FIG. 4 BACKGROUND ART
FIG. 4 shows a sectional view of a conventional prior art internal combustion engine.
Figure 5:
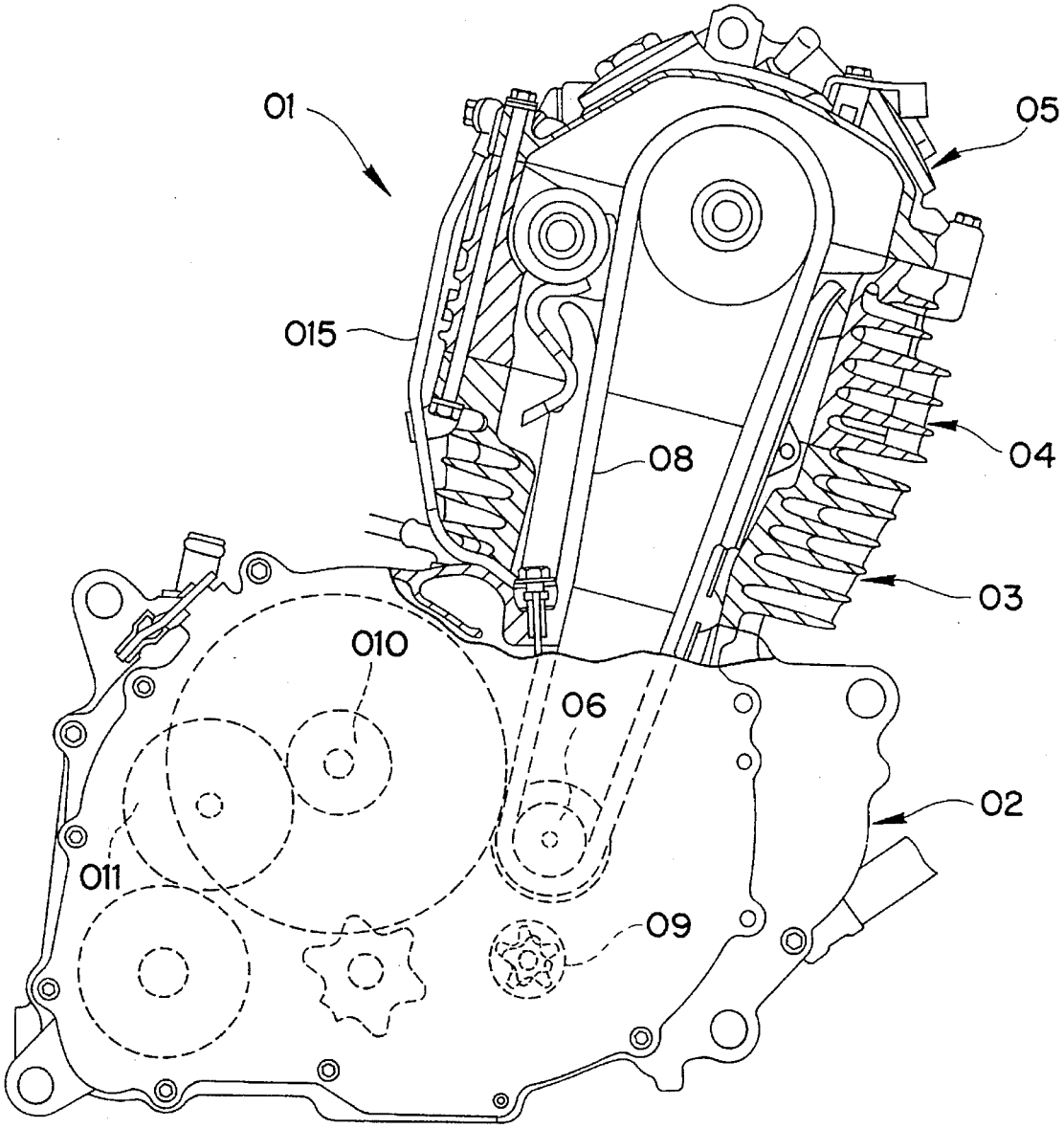
FIG. 5 BACKGROUND ART
FIG. 5 shows a side view of the internal combustion engine of FIG. 4 with parts partially broken away and partially omitted.

As shown in FIGS. 2 and 3, engine oil reserved in the bottom portion of the crank case 2 passes through an oil filter 33 and an oil passage t1. The oil is fed under pressure to an oil passage t2 from the scavenging side **30*a* of the oil pump 30. The oil passage t2 is in communication with an external oil pipe 35 of the internal combustion engine 1 through a connecting member 34 which reaches an oil tank. Therefore, oil reserved in the bottom portion of the crank case 2** is returned to the oil tank through the above route.

Oil in the oil tank passes through an oil pipe 36, a connecting member 37, and an oil passage t3. The oil is fed under pressure to the oil passage t4 by way of the field side **30*b* of the oil pump 30. Then, the oil passes through an oil passage t5 in communication with an oil filter 38 positioned slightly obliquely and upwardly from the oil pump 30. The oil is fed to the outer periphery of the cylindrical oil filter 38. The oil path branches so that oil fed from the outer periphery to an outlet 38*a* is fed under pressure either into a downwardly extending oil passage t6 or an upwardly extending oil passage t7**.

The oil flowing through the downwardly extending oil passage t6 reaches a large diameter end portion of the crank shaft 3, flowing in the oil passage **3*a* of the crank shaft 3. The oil is supplied into the crank pin 3*b*, to be thus supplied to the sliding portion with the connecting rod 13**.

On the other hand, the oil flowing from the outlet **38*a* of the oil filter 38 to the upwardly extending oil passage t7 is branched at an intermediate branch portion into an oil passage t8 and oil passage t11. The oil passage t8 extends rearwardly along the upper wall of the crank case 2 and the oil passage t11 extends upwardly along the outer wall of the cylinder block 10**.

The oil flowing in the oil passage t8 enters an oil passage t9 branched from the middle of oil passage t8. The oil is led to the main shaft 5 and reaches an oil passage **5*a* in the main shaft 5. This oil is then supplied to the bearing portion of each gear. The oil not flowing in the oil passage t9 enters an oil passage t1O directed to the counter shaft 6, and reaches an oil passage 6*a* in the counter shaft 6**. This oil is supplied to the bearing portion of each gear for lubrication.

On the other hand, the oil passage t11 is formed between the chain path **10*a* passing through the side wall of the cylinder block 10 and the outer surface thereof as shown in FIG. 1. The oil passage t11 is further connected to an oil passage t12 formed between the chain path 15*a* passing through the side wall of the cylinder head 15 and the outer surface thereof. The oil passage t12 is in communication with an oil chamber 40 provided at the end portion of the cam shaft 17**.

The end portion of the cam shaft 17 is supported by a bearing having a sealing property. An internal oil passage **17*a* is opened to the oil chamber 40**.

Accordingly, the oil flowing upwardly through the oil passages t11 and t12 enters the oil chamber 40, and it flows in the internal oil passage **17*a* of the cam shaft 17, passing through branch passages 17*b* radially branched from the oil passage 17*a*. This oil is therefore supplied to a bearing portion and a sliding contact portion of the rocker arm 21**.

The oil collected in the upper portion of the cylinder head 15 passes through the chain paths **15*a* and 10*a* of the cam chain 22 and is reserved in the bottom portion of the crank case 2. The oil thus reserved, as described above, passes through the oil filter 33 and the oil passage t1, flowing along the scavenging side 30*a* of the oil pump 30. The oil is returned into the oil tank by way of the oil pipe 35**. The oil is circulated in this way.

In the present invention, a valve system such as the cam shaft 17 is positioned separately from the cylinder. The oil passages t11 and t12 for supplying oil are integrally formed in the cylinder block 10 and the cylinder head 15. It is therefore possible to eliminate separate parts such as an oil pipe and also the assembling work thereof, and hence to reduce the manufacturing cost.

The spaces of the chain paths **10*a* and 15*a*, through which the cam chain 22 is disposed, are effective to separate the oil passages t11 and t12 from the combustion chamber 16 and the cylinder liner 11 as heat sources of the internal combustion engine 1. Therefore, the oil passages t11 and t12 are less susceptible to combustion heat thereby suppressing the heating of oil supplied to the valve system such as the cam shaft 17. Moreover, since the oil passages t11 and t12 are formed along the outer surface of the cylinder block 10 and the cylinder head 15, it becomes possible to expect the air cooling effect, and to avoid the supply of heated oil to the valve system. Therefore, the positioning of the oil passages t11 and t12 acts as means for isolating oil flowing to the cam shaft 17 in the cylinder head 15 from heat of internal combustion chamber 16** such that temperature of the oil is kept at a predetermined level. This predetermined temperature is less than a temperature of oil heated by the combustion heat.

According to the present invention, oil passages to the valve system are formed integrally with the cylinder block and the cylinder head. It is therefore possible to eliminate separate parts such as an oil pipe and to reduce the assembling work thereof, and hence to reduce the manufacturing cost. The oil passages are positioned at the opposed side to the cylinder liner and combustion chamber relative to the valve system drive transmission, so that it is possible to avoid the direct heating due to the heat sources. Further, since the oil passages are formed along the outer surface, there can be a cooling effect. As a consequence, unheated oil can be supplied to the valve system.

Since the valve system drive transmission is constituted of a cam chain for transmitting the rotation of the crank shaft to the cam shaft of the valve system, the cam chain spaces are effective to separate the oil passages from the cylinder liner and the combustion chamber. Accordingly, it is difficult to transmit the heat of the heat sources to the oil passages. A cooling effect can also be obtained, thus making it possible to avoid the heating of oil supplied to the valve system.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An arrangement of oil passages for a valve system for an internal combustion engine, the engine having a cylinder block and a cylinder head, the arrangement comprising oil passages extending to a valve system of the engine, at least one of the oil passages being formed integrally with the cylinder block and the cylinder head, the at least one oil passage formed integrally with the cylinder block and cylinder head being disposed along outer surfaces of the cylinder block and cylinder head, a valve system drive transmission being disposed between the at least one oil passage and a combustion chamber of the engine.

2. The arrangement of oil passages as recited in claim 1, wherein said valve system drive transmission is a cam chain for transmitting rotation of a crank shaft to a cam shaft of the valve system.

3. The arrangement of oil passages as recited in claim 1, wherein the engine includes a crank case and an oil pump and wherein the at least one oil passage formed in the cylinder block and the cylinder head comprises an outer passage, the oil passages further including a first oil passage in communication with an oil reserve in the crank case, a second oil passage in communication with the oil pump and an external oil pipe connected to the second oil passage.

4. The arrangement of oil passages as recited in claim 3, wherein the oil passages further include a third oil passage and a fourth the oil passage, the third oil passage being operatively connected to the external oil pipe, the third and fourth oil passages being connected to the oil pump whereby oil is fed from the external oil pipe to the third oil passage through the oil pump and then to the fourth oil passage.

5. The arrangement of oil passages as recited in claim 4, wherein the engine further comprises an oil filter and wherein the oil passages further include a fifth oil passage, a sixth oil passage and a seventh oil passage, the fifth oil passage connecting the fourth oil passage to the oil filter, the sixth and seventh oil passages extending from the oil filter, the sixth oil passage extending downwardly from the oil filter to the crank shaft and the seventh oil passage extending upwardly relative to the sixth oil passage.

6. The arrangement of oil passages as recited in claim 5, wherein the engine further comprises a main shaft and a counter shaft and wherein the at least one oil passage formed integrally with the cylinder block and cylinder head comprises an eleventh oil passage and a twelfth oil passage and wherein the oil passages further include an eighth oil passage, a ninth oil passage and a tenth oil passage, the eighth oil passage and eleventh oil passage being directly connected to the seventh oil passage, the eighth oil passage extending within the crank case and the eleventh oil passage extending from the crank case to the cylinder block, the eleventh oil passage being connected to the twelfth oil passage and the twelfth oil passage extending through the cylinder head, the ninth oil passage extending from the eight oil passage to the main shaft and the tenth oil passage extending to the counter shaft.

7. The arrangement of oil passages as recited in claim 6, wherein the engine further comprises a cam shaft and wherein the twelfth oil passage is in communication with an oil chamber provided at an end portion of the cam shaft, oil passing from the twelfth oil passage to the cam shaft collecting in an upper portion of the cylinder head and thereafter passing through chain paths of a cam chain from the cylinder head to a bottom of the crank case.

8. The arrangement of oil passages as recited in claim 1, wherein the engine includes a crank shaft in a crank case, the cylinder block being connected between the crank case and the cylinder head and wherein a cam shaft is mounted in the cylinder head, the cam shaft having a cam chain operatively connected to one end thereof, the cam chain extending from the cam shaft in the cylinder head through the cylinder block to the crank shaft in the crank case, the cam chain extending along chain paths and the oil being moved from the cylinder head to the crank shaft through the chain paths, the at least one passage integrally formed with the cylinder block and the cylinder head being along the outer surface of the cylinder block and the cylinder head, the outer surface of the cylinder block and cylinder head being opposed to an inner surface thereof, the chain paths being along the inner surface of the cylinder block and the cylinder head.

9. The arrangement of oil passages as recited in claim 8, wherein the chain paths are generally in a first plane and wherein a second plane is generally perpendicular to the first plane, the second plane passing through and being coincident with the at least one passage, the second plane terminating at ends of the at least one passage and being encircled by the cam chain.

10. The arrangement of oil passages as recited in claim 9, wherein the at least one passage integrally formed with the cylinder block and the cylinder head comprises two connected oil passages, one of the two passages being integrally formed with the cylinder block along the outer surface thereof and another of the two oil passages being integrally formed with the cylinder head along the outer surface thereof.

11. An arrangement of oil passages for an internal combustion engine, the engine having a cylinder block, a cylinder head and a crank case, the cylinder block being positioned between the cylinder head and the crank case, the cylinder block and the cylinder head forming an internal combustion chamber of the engine, the engine further having a crank in the crank case, a cam shaft in the cylinder head and a cam chain extending from the cam shaft through the cylinder block to the crank shaft, the cam chain being located within the cylinder block, the cylinder head, and the crank case, the arrangement comprising at least one oil passage for flow of oil from the crank case to the cylinder head and means for isolating oil flowing to the cam shaft in the cylinder head from heat of the internal combustion chamber to thereby maintain a predetermined temperature of oil in the at least one passage, the means for isolating comprising the at least one oil passage being located along an exterior of the cylinder block and the cylinder head, a valve system drive transmission being disposed between the at least one oil passage and the combustion chamber of the engine, the at least one oil passage being integrally formed with the cylinder block and the cylinder head and being separated from the combustion chamber.

12. The arrangement of oil passages as recited in claim 11, wherein the predetermined temperature is less than a temperature of oil heated directly by the combustion chamber of the engine and wherein the at least one oil passage comprises two connected oil passages, one of the two passages being integrally formed with the cylinder block along the outer surface thereof and another of the two oil passages being integrally formed with the cylinder head along the outer surface thereof.

13. The arrangement of oil passages as recited in claim 11, wherein the cam chain extends along chain paths, oil being moved from the cylinder head to the crank case through the chain paths, the at least one oil passage integrally formed with the cylinder block and the cylinder head being along the outer surface of the cylinder block and the cylinder head, the outer surface of the cylinder block and cylinder head being opposed to an inner surface thereof, the chain paths being along the inner surface of the cylinder block and the cylinder head.

14. The arrangement of oil passages as recited in claim 13, wherein the chain paths are generally in a first plane and wherein a second plane is generally perpendicular to the first plane, the second plane passing through and being coincident with the at least one passage, the second plane terminating at ends of the at least one passage and being encircled by the cam chain.

15. The arrangement of oil passages as recited in claim 11, wherein the engine further includes an oil pump and wherein the at least one oil passage formed in the cylinder block and the cylinder head comprises an outer passage, the oil passages further including a first oil passage in communication with an oil reserve in the crank case, a second oil passage in communication with the oil pump and an external oil pipe connected to the second oil passage.

16. The arrangement of oil passages as recited in claim 15, wherein the oil passages further include a third oil passage and a fourth the oil passage, the third oil passage being operatively connected to the external oil pipe, the third and fourth oil passages being connected to the oil pump whereby oil is fed from the external oil pipe to the third oil passage through the oil pump and then to the fourth oil passage.

17. The arrangement of oil passages as recited in claim 16, wherein the engine further comprises an oil filter and wherein the oil passages further include a fifth oil passage, a sixth oil passage and a seventh oil passage, the fifth oil passage connecting the fourth oil passage to the oil filter, the sixth and seventh oil passages extending from the oil filter, the sixth oil passage extending downwardly from the oil filter to the crank shaft and the seventh oil passage extending upwardly relative to the sixth oil passage.

18. The arrangement of oil passages as recited in claim 17, wherein the engine further comprises a main shaft and a counter shaft and wherein the at least one oil passage formed integrally with the cylinder block and cylinder head comprises an eleventh oil passage and a twelfth oil passage and wherein the oil passages further include an eighth oil passage, a ninth oil passage and a tenth oil passage, the eighth oil passage and eleventh oil passage being directly connected to the seventh oil passage, the eighth oil passage extending within the crank case and the eleventh oil passage extending from the crank case to the cylinder block, the eleventh oil passage being connected to the twelfth oil passage and the twelfth oil passage extending through the cylinder head, the ninth oil passage extending from the eight oil passage to the main shaft and the tenth oil passage extending to the counter shaft.

19. The arrangement of oil passages as recited in claim 18, wherein the twelfth oil passage is in communication with an oil chamber provided at an end portion of the cam shaft, oil passing from the twelfth oil passage to the cam shaft collecting in an upper portion of the cylinder head and thereafter passing through chain paths of a cam chain from the cylinder head to a bottom of the crank case.

20. The arrangement of oil passages as recited in claim 11, wherein the engine comprises a cylinder liner positioned between the combustion chamber and the cam chain, oil being moved from the cylinder head to the crank case through the chain paths, the at least one passage integrally formed with the cylinder block and the cylinder head being along the outer surface of the cylinder block and the cylinder head, the outer surface of the cylinder block and cylinder head being opposed to an inner surface thereof, the chain paths being along the inner surface of the cylinder block and the cylinder head.

* * * * *